US008596474B2

(12) United States Patent
Steindl

(10) Patent No.: US 8,596,474 B2
(45) Date of Patent: Dec. 3, 2013

(54) CRANE

(75) Inventor: Johannes Steindl, Elsbethen (AT)

(73) Assignee: EPSILON Kran GmbH, Bergheim (AT)

( * ) Notice: Subject to any disclaimer, the term of this patent is extended or adjusted under 35 U.S.C. 154(b) by 675 days.

(21) Appl. No.: 12/772,318

(22) Filed: May 3, 2010

(65) Prior Publication Data

US 2010/0282702 A1 Nov. 11, 2010

(30) Foreign Application Priority Data

May 7, 2009 (AT) ..... A 691/2009

(51) Int. Cl.
*B66C 23/00* (2006.01)

(52) U.S. Cl.
USPC ..... 212/299; 212/294; 212/300

(58) Field of Classification Search
USPC ..... 212/294, 298, 299, 300, 350
See application file for complete search history.

(56) References Cited

U.S. PATENT DOCUMENTS

| | | | | | |
|---|---|---|---|---|---|
| 3,032,206 | A | * | 5/1962 | McIntyre, Sr. | 212/238 |
| 3,032,207 | A | * | 5/1962 | McIntyre | 212/238 |
| 3,035,711 | A | * | 5/1962 | Rehnstrom | 212/238 |
| 3,216,588 | A | * | 11/1965 | Sundin | 212/292 |
| 3,265,219 | A | * | 8/1966 | Sundin | 212/300 |
| 3,389,820 | A | * | 6/1968 | Borer et al. | 414/713 |
| 3,465,904 | A | * | 9/1969 | Pensa | 414/694 |
| 3,533,515 | A | * | 10/1970 | Milner, Jr. | 212/288 |
| 3,536,216 | A | * | 10/1970 | Woolman et al. | 414/694 |
| 3,870,162 | A | * | 3/1975 | Nakajo | 212/300 |
| 3,913,768 | A | * | 10/1975 | Grooss et al. | 414/711 |
| 4,109,807 | A | * | 8/1978 | Yoshida | 414/716 |
| 4,183,712 | A | * | 1/1980 | Lindberg | 414/738 |
| 4,185,945 | A | * | 1/1980 | Gill | 414/727 |
| 4,393,607 | A | * | 7/1983 | Hirosawa | 37/443 |
| 4,475,870 | A | * | 10/1984 | Eickmann | 417/206 |
| 4,925,358 | A | * | 5/1990 | Cook | 414/685 |

(Continued)

FOREIGN PATENT DOCUMENTS

| | | |
|---|---|---|
| DE | 69 16 283 | 9/1969 |
| DE | 1 920 593 | 11/1970 |

(Continued)

OTHER PUBLICATIONS

European Search Report issued Aug. 25, 2010 in European Patent Application No. EP 10 00 4785 corresponding to present U.S. application.

(Continued)

*Primary Examiner* — Emmanuel M Marcelo
*Assistant Examiner* — Michael Gallion
(74) *Attorney, Agent, or Firm* — Wenderoth, Lind & Ponack, L.L.P.

(57) ABSTRACT

A crane, in particular a vehicle crane, includes a first crane arm and at least one second crane arm which are connected together by a joint. The crane arms are pivotable relative to each other by a drive having a piston-cylinder unit, in each case starting from one of the two end positions in which the crane arms are in substantially mutually parallel relationship until reaching a dead point when the longitudinal axis of the piston-cylinder unit is substantially on a line with the joint. There is provided at least one second drive by which it is possible to go beyond the dead point position of the piston-cylinder unit relative to the joint.

19 Claims, 9 Drawing Sheets

(56) References Cited

U.S. PATENT DOCUMENTS

| | | | | |
|---|---|---|---|---|
| 5,083,689 | A * | 1/1992 | Vaterlaus | 222/602 |
| 5,266,001 | A * | 11/1993 | Kanayama et al. | 414/694 |
| 5,584,643 | A * | 12/1996 | Nishimura et al. | 414/694 |
| 5,885,050 | A * | 3/1999 | Kim | 414/713 |
| 6,095,500 | A * | 8/2000 | McVaugh | 254/361 |
| 6,290,078 | B1 * | 9/2001 | Verchere | 212/300 |
| 6,966,448 | B1 * | 11/2005 | Burkett | 212/180 |
| 7,134,562 | B2 * | 11/2006 | Burkett | 212/180 |
| 7,698,838 | B1 * | 4/2010 | Strayhorn | 37/395 |
| 8,142,132 | B2 * | 3/2012 | Lech et al. | 414/699 |

FOREIGN PATENT DOCUMENTS

| | | |
|---|---|---|
| EP | 0 733 585 | 9/1996 |
| EP | 1 475 345 | 11/2004 |
| GB | 579545 | 8/1946 |
| JP | 1-142134 | 6/1989 |
| JP | 2003-104686 | 4/2003 |

OTHER PUBLICATIONS

Austrian Search Report issued Mar. 31, 2010 in A 691/2009.

* cited by examiner

CRANE

BACKGROUND OF THE INVENTION

The invention concerns a crane, in particular a vehicle crane, comprising a first crane arm and at least one second crane arm which are connected together by way of a joint and which are pivotable relative to each other by way of a drive having a piston-cylinder unit, in each case starting from one of the two end positions in which the crane arms are in a substantially mutually parallel relationship until reaching a dead point when the longitudinal axis of the piston-cylinder unit is substantially on a line with the joint.

A conventional method of overcoming the dead point position of a piston-cylinder unit relative to the joint is that in which the crane arms are pressed with their load pick-up means against the ground beneath the crane arms. The torque which occurs in that case in relation to the joint moves the piston-cylinder unit beyond the dead point and the crane can be folded together. That method is extremely inexpensive as no additional material expenditure is necessary. The disadvantage of that method is that the operation of folding the crane together is relatively time-consuming and takes up a great deal of space as the crane arms—strictly speaking the load pick-up means—must make ground contact while the two crane arms are opened out. Often such cranes are designed so that the drive has not just one piston-cylinder unit but, for example, two piston-cylinder units which are disposed in parallel, and which acting symmetrically in the same direction move the two crane arms relative to each other. In that case, the dead point of the two piston-cylinder units occurs at the same position of the joint, and the movement for going beyond the dead point position has to be effected in the same fashion as just described.

DE 69 16 283 discloses a rotary joint arrangement for folding booms, having an intermediate member between the two crane arms and two stroke cylinders mounted to the crane arms and the intermediate member. The overall pivotal angle is increased by one stroke cylinder implementing a pivotal range of about 160 degrees and the second stroke cylinder implementing a further additional pivotal range of about 120 degrees. That, therefore, avoids having to overcome the dead point of a stroke cylinder as neither of the two stroke cylinders has to be extended as far as its dead point. In that way, the working ranges are sharingly allocated to the two stroke cylinders. The disadvantage of this method is that it involves an increased expenditure on material and thus increased costs as an intermediate member and two powerful stroke cylinders are necessary to achieve a pivotal range for the two crane arms, which is greater than 180 degrees.

SUMMARY OF THE INVENTION

The object of the invention is to avoid the above-described disadvantages and to provide a crane which is improved in relation to the state of the art and in which the dead point of the piston-cylinder unit relative to the joint is overcome.

In the crane according to the invention, that object is attained in that there is provided at least one further drive by which it is possible to go beyond the dead point position of the piston-cylinder unit relative to the joint.

In other words, that further drive provides that a piston-cylinder unit which is in the region of the dead point position—strictly speaking the dead point occurs when the force vector of the piston-cylinder unit is in a line with the joint between the first crane arm and the second crane arm—is moved out of that dead point position and thus the piston-cylinder unit again provides for the further pivotal movement of the two crane arms relative to each other. Accordingly, the pivotal movement of the two crane arms—apart from the region of the dead point position—takes place over the entire range of approximately 360 degrees with one and the same piston-cylinder unit. The further drive is required exclusively in the region of the dead point position of the two crane arms and thus only has to be so powerful that its force is sufficient to overcome the dead point. The further drive does not have to be designed to further pivot the two crane arms as, after the dead point has been overcome, the piston-cylinder unit again takes over performing the pivotal movement, so it could thus be viewed as an auxiliary drive. The previous construction of a crane—in contrast to the crane disclosed in DE 69 16 283—can be retained, no major modifications are necessary, the crane arms are only additionally equipped with a further drive. It is thus also possible for existing cranes to be subsequently equipped with such a further drive to overcome a dead point position of the piston-cylinder unit. The amount of space required during the inward pivotal movement is minimized as there is no need for the opened crane arms to be supported against the underlying ground and that can equally be effected in the lifted condition of the crane arms, which is a great advantage in particular in a tight space as between houses, on building sites and in woods etc. It should be noted in that respect that it is naturally also possible to design the piston-cylinder unit so that, for example, two substantially parallel piston-cylinder units are used, which acting symmetrically in the same direction move the two crane arms relative to each other. Using a further drive means that there is also no reliance on an additional joint or intermediate member between the two crane arms and the piston-cylinder unit to permit a pivotal movement beyond the dead point region.

Preferably the further drive includes a linear drive, in that case it is particularly advantageous if the linear drive has a piston-cylinder unit as that both permits a small structural configuration and can also be protected well from environmental influences.

Preferably, the further drive is provided with a pulling means which extends from the underside of the first crane arm past the joint to the top side of the second crane arm and thereby permits good transmission of force while requiring a small amount of space. A chain is also particularly advantageous here as the pulling means, while it will be appreciated that belts, cables and other movable pulling means are also possible.

In accordance with a preferred embodiment, it can be provided that the further drive is caused to act by way of a releasable coupling device as that permits small structural sizes and thus the folding-together movement is not limited by linkages, hinge joints or the like. Thus, for example, the first coupling portion can be in the form of a receiving device and the received second coupling portion can be provided on the further drive. Preferably, the releasable coupling device can also be provided with a lever as that permits improved transmission of force.

It has proven to be particularly advantageous in that respect if the further drive is provided in the interior of one of the two crane arms as that therefore means that no space is taken up at the outside of one of the two crane arms and this therefore ensures maximum space saving and maximum capability for the arms to be folded together.

Preferably the crane arms are telescopic as that makes it possible to achieve greater radii of action.

In accordance with a preferred configuration it can be provided that the crane is equipped with a control device which triggers automatic switching-over of the operative direction of the piston-cylinder unit so that manual switching-over is not required. Preferably that switching-over process is performed by a switching device having a switching valve which operates as a limit switch which at the switching point causes reversal of the piston-cylinder unit. It will be appreciated that as the switching device it is equally possible to consider any other technical option which can trigger a switching process, such as for example a sensor or a light barrier arrangement or the like.

In accordance with a preferred configuration, the further drive can be so arranged on the crane arm so that the dead point position of the piston-cylinder unit occurs at a different joint position from the dead point position of the piston-cylinder unit of the further drive. It is thus possible for a piston-cylinder unit to move the other piston-cylinder unit out of the dead point position thereof.

It has proven to be particularly advantageous in that respect if the piston-cylinder units of the drives are designed so that they are substantially equivalent and the arrangement thereof relative to each other is substantially parallel at the sides of the first crane arm and asymmetrical at the sides of the second crane arm.

As a particularly suitable area of use, the crane can be in the form of a Z-crane having a rotatably mounted vertical crane mast, a lift arm pivotably mounted thereto and at least one bending arm rotatably hingedly connected to the lift arm. Hereinafter by way of example, the lift arm is referred to as the first crane arm and the bending arm as the second crane arm, but that is not to be considered as a limitation.

In specific terms such a crane can be used on a vehicle.

BRIEF DESCRIPTION OF THE DRAWINGS

Further details and advantages of the present invention will be described more fully hereinafter by means of the specific description with reference to the embodiments by way of example illustrated in the drawing in which.

DETAILED DESCRIPTION OF THE INVENTION

Figure 1:
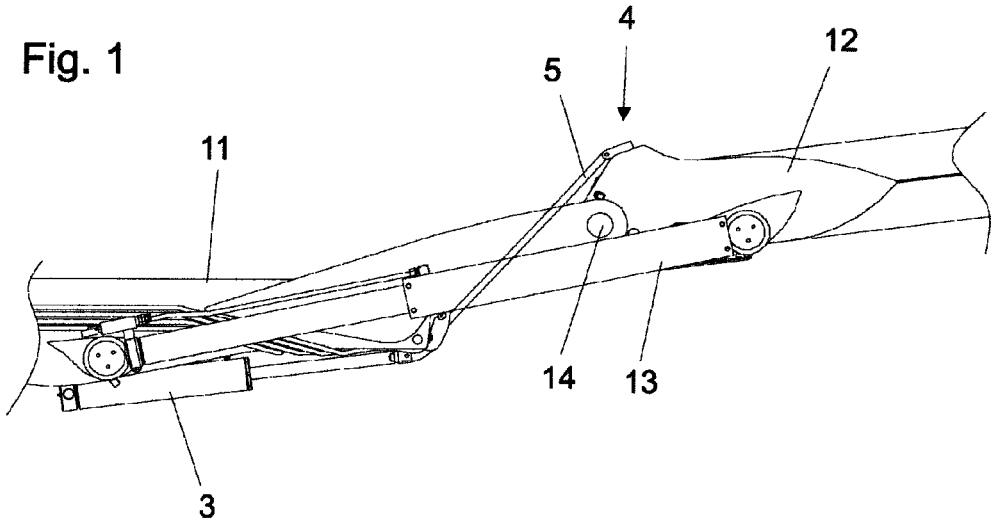
FIGS. 1 through 8 show 8 diagrammatic views of embodiments of an arrangement according to the invention.

FIG. 1 shows a first crane arm 11 hingedly connected to a second crane arm 12 by way of the joint 14. Mounted at the underside of the first crane arm 11 is a further (second) drive which has a second piston-cylinder unit 3. The piston-cylinder unit 3 is connected by way of a chain 5 to the second crane arm 12. The pivotal extension movement takes place as usual—without the assistance of the second drive when a first piston-cylinder unit 13 of a first drive extends the second crane arm 12 until the piston-cylinder unit 13 passes into the region of the dead point (when the longitudinal axis of the piston-cylinder unit 13 and the joint 14 extend in a line). By virtue of the force of gravity, the dead point position is overcome and the piston-cylinder unit 13 can retract and move the second crane arm 12. For the inward pivotal movement of the second crane arm 12, the piston-cylinder unit 13 of the first drive extends until it passes into the region of its dead point. The piston-cylinder unit 3 of the second drive now takes effect, and the chain 5 moves the second crane arm 12. As a result, the piston-cylinder unit 13 moves beyond its dead point position. The piston-cylinder unit 13 then retracts until the two crane arms reach their end position, the parking position.

Figure 2:
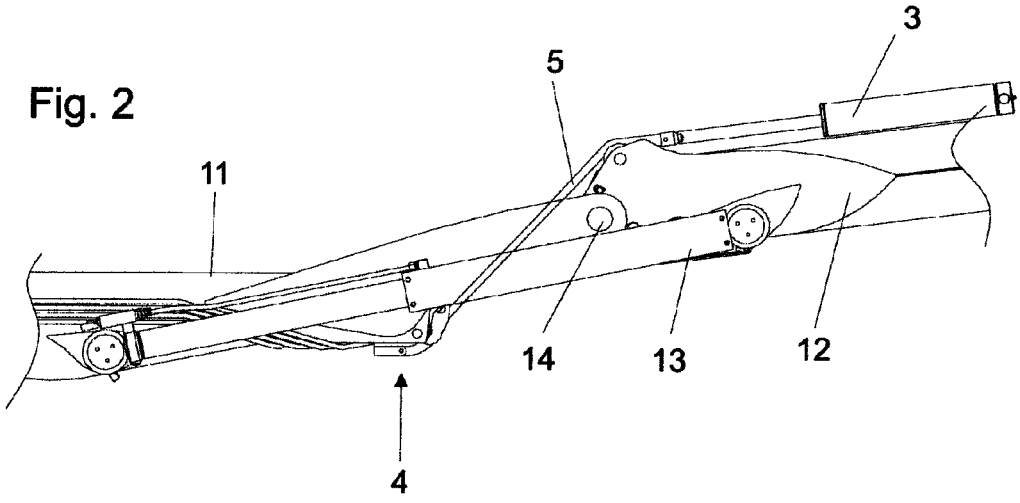

FIG. 2 shows a variant of FIG. 1 in which the piston-cylinder unit 3 of the second drive is fixed at the underside of the second crane arm 12. The path of the chain 5 of the second drive is equally from the underside of the first crane arm 11 to the top side of the second crane arm 12. The mode of operation involved in the inward pivotal movement is accordingly identical to the description of FIG. 1.

Figure 3:
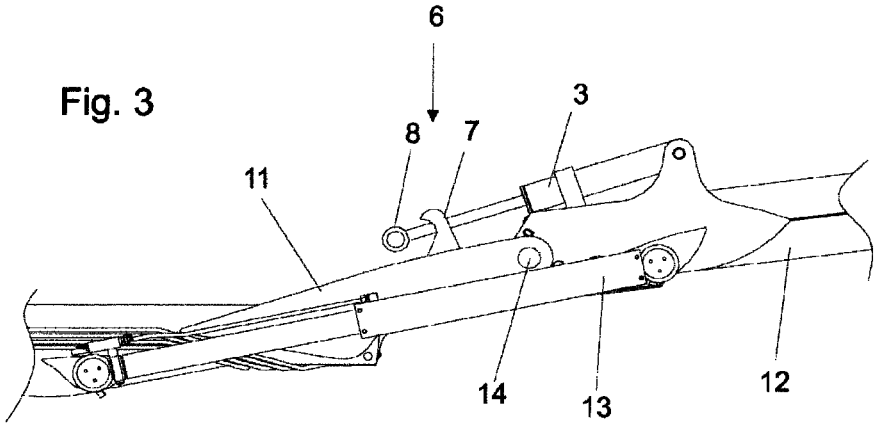

FIG. 3 shows a releasable coupling device 6 in which a first coupling portion 7 which is in the form of a catching receiving device is fixed to the first crane arm 11 and the second coupling portion 8 is mounted to the piston-cylinder unit 3 of the further drive. In the region of the dead point position of the first piston-cylinder unit 13, the second piston-cylinder unit 3 of the second drive retracts and the second coupling portion 8 engages into the first coupling portion 7 and thus provides that the second crane arm 12 is folded upwardly and the piston-cylinder unit 13 is moved out of its dead point position. The piston-cylinder unit 13 then retracts until the two crane arms reach their end position, the parking position, in which case the two coupling portions 7 and 8 have separated from each other again during the retraction movement.

Figure 4:
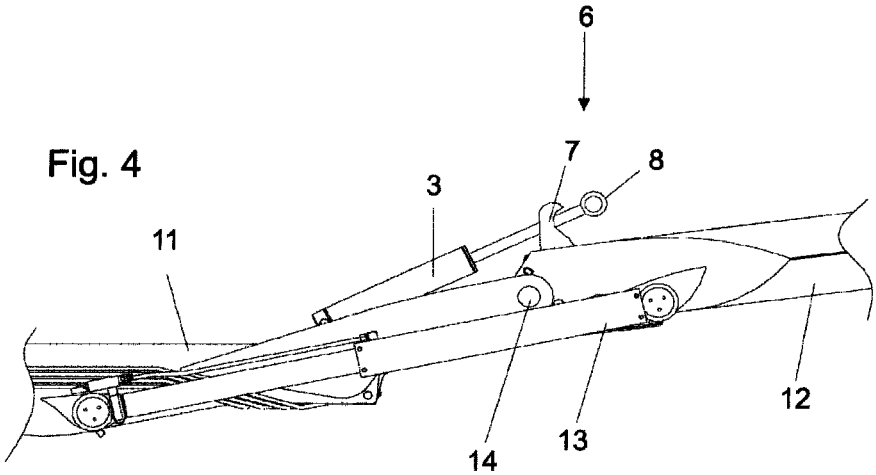

FIG. 4 shows a variant of FIG. 3 in which the second piston-cylinder unit 3 of the second drive is on the first crane arm 11 and the first coupling portion 7, also in the form of a catching receiving device, is on the second crane arm 12. The mode of operation of the inward pivotal process is in substance identical to the description of FIG. 3.

Figure 5:
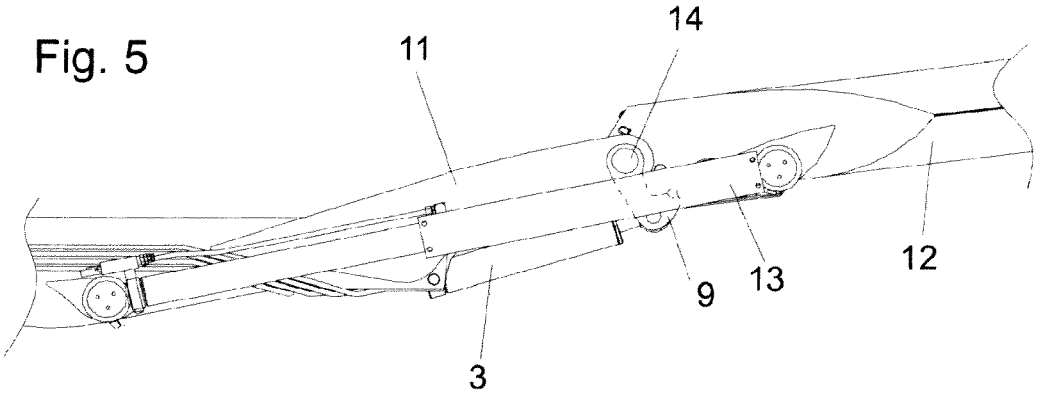

FIG. 5 shows how the second piston-cylinder unit 3 of the second drive, which is on the first crane arm 11, presses against a lever 9 which is on the second crane arm 12 and thus can overcome the dead point position of the piston-cylinder unit 13 relative to the joint 14. The procedure involved in the inward pivotal movement is in substance identical to the preceding illustrated examples.

Figure 6:
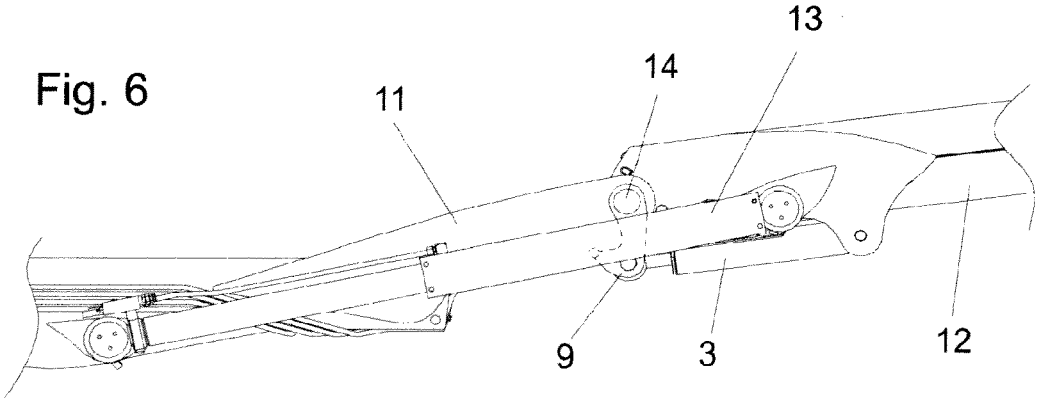

FIG. 6 shows a variant of FIG. 5 in which the second piston-cylinder unit 3 of the second drive is on the second crane arm 12 and the lever 9 is on the first crane arm 11. The procedure involved in the inward pivotal movement is in substance identical to the preceding illustrated examples.

Figure 7:
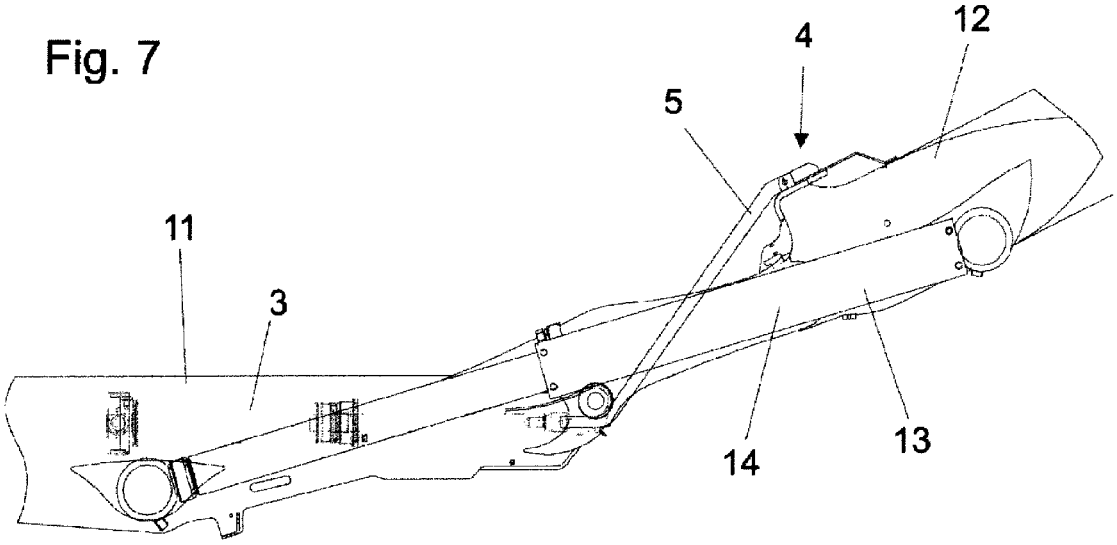

FIG. 7 shows a variant of FIG. 1 in which the second drive is in the interior of the first crane arm 11 and is not at the outside of one of the two crane arms. That therefore affords the maximum saving of space. The mode of operation of the inward pivotal movement is identical to the description relating to FIG. 1.

Figure 8:
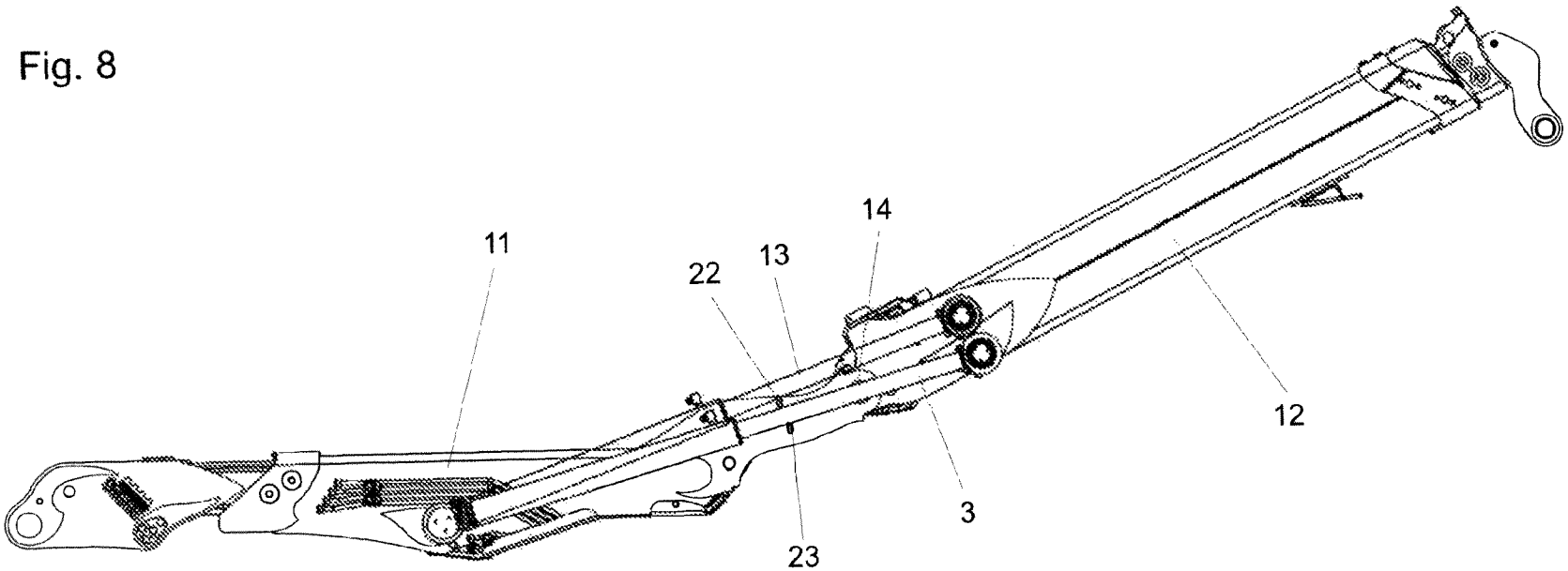

FIG. 8 shows an asymmetrical arrangement of the first piston-cylinder unit 13 of the first drive relative to the second piston-cylinder unit 3 of the second drive from the first crane arm 11 to the second crane arm 12. The first piston-cylinder unit 13 is mounted on the left-hand side of the crane arms and the second piston-cylinder unit 3 of the second drive is mounted on the right-hand side of the crane arms. For the sake of improved clarity of the drawing, FIG. 8 visibly shows both piston-cylinder units so that the differences can be better perceived. In that case, the piston-cylinder unit 3 of the second drive is pivotably mounted at a different lower position on the crane arm 12 than the piston-cylinder unit 13, thus providing that the dead point position of the respective piston-cylinder unit occurs at a differing position in respect of the joint 14. For inward pivotal movement of the second crane arm 12, both the first piston-cylinder unit 13 and also the second piston-cylinder unit 3 of the second drive extend until the first piston-cylinder unit 13 passes into the region of its dead point. In that case, the second piston-cylinder unit 3 of the second drive has not yet reached its dead point and is further extended and thus ensures that the piston-cylinder unit 13 overcomes its dead point. The two piston-cylinder units then retract until the two crane arms reach their end position, the parking position.

Figure 9:
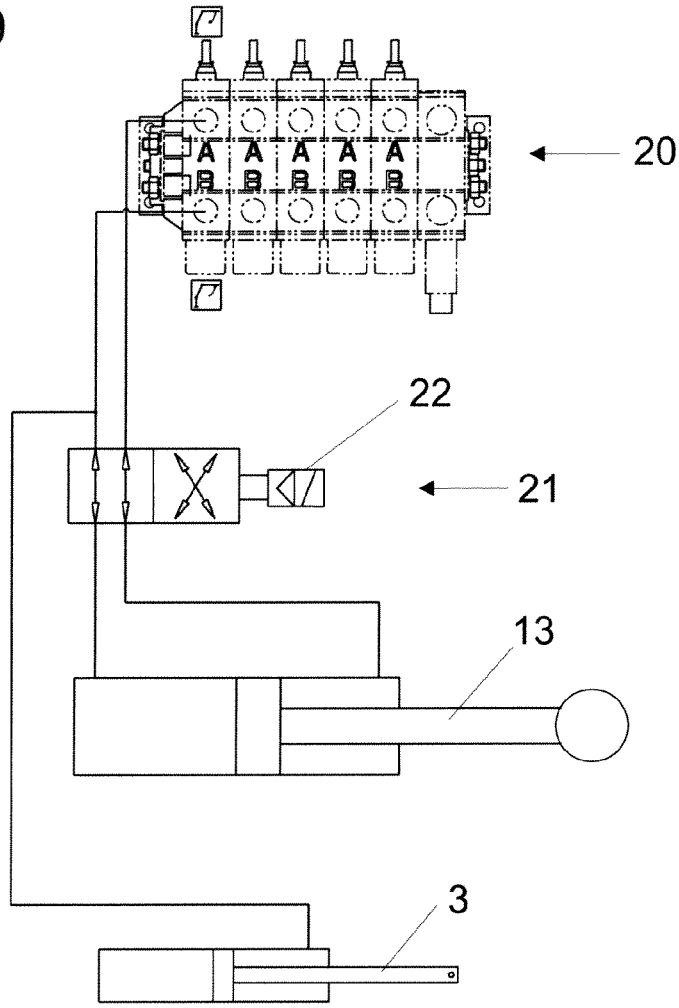
FIGS. 9 through 11 show diagrammatic views of the control and switching device.

FIG. 9 shows a control device 20 which, by way of a switching device 21, causes the first piston-cylinder unit 13 to perform a directional reversal in respect of its operative direction. That directional reversal is triggered by the switching valve 22 which functions as a limit switch.

Figure 10:
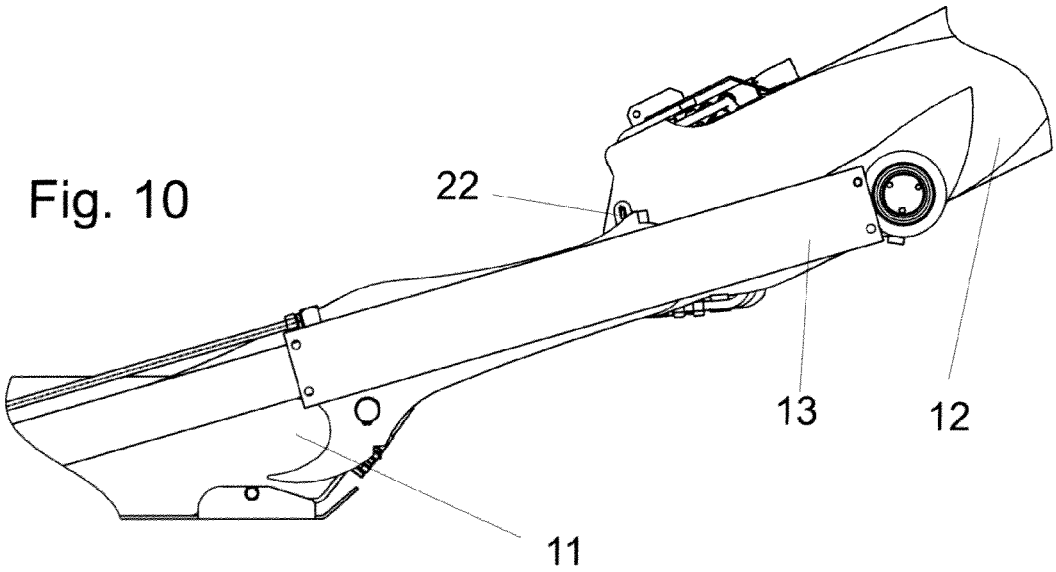

FIG. 10 shows the two outwardly folded crane arms of a crane and a switching valve 22 which, in the region of the dead point position of the first piston-cylinder unit 13 relative to the joint 14, causes the control device 20 to implement a directional reversal in the operative direction of the first piston-cylinder unit 13. Thus, there is no need for manual counteracting control or for switching-over by the operator, and the two crane arms retract to their end position, the parking position.

Figure 11:
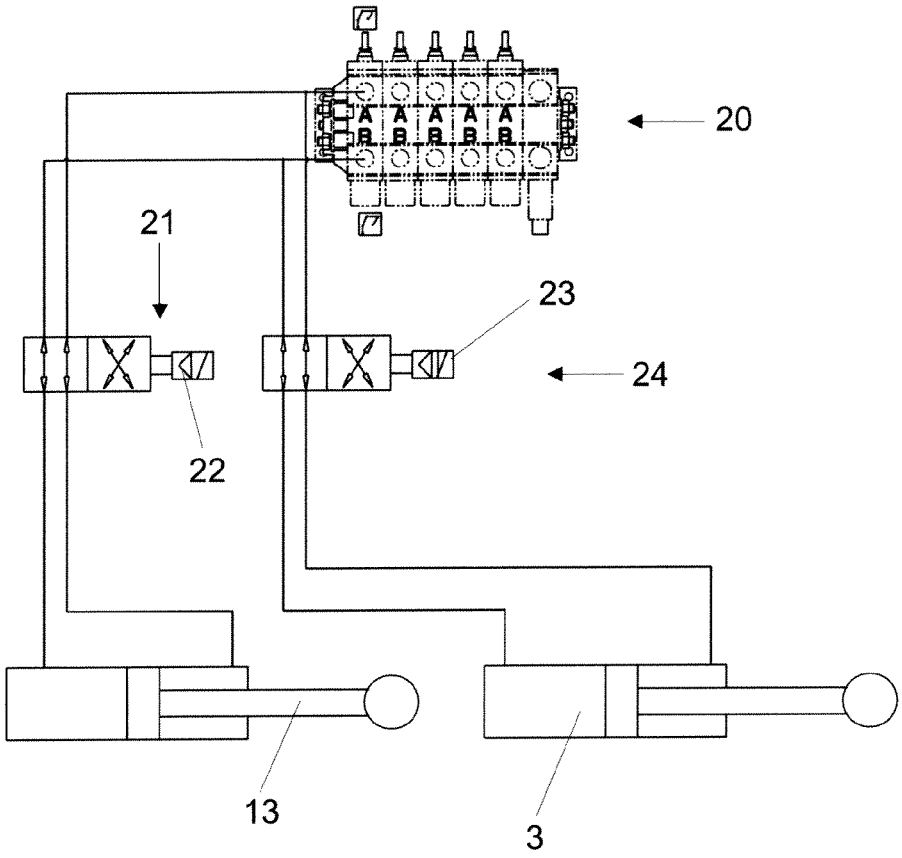

FIG. 11 shows a control device 20 which, by way of the switching device 21, causes the first piston-cylinder unit 13 to perform a directional reversal in respect of its operative direction. That directional reversal is triggered by the switching valve 22 (see in that respect also FIG. 8). In addition, the piston-cylinder unit 3 is caused by way of the switching device 24 to perform a directional reversal in respect of its operative direction. That directional reversal is triggered by the switching valve 23 (see in that respect also FIG. 8).

Figure 12:
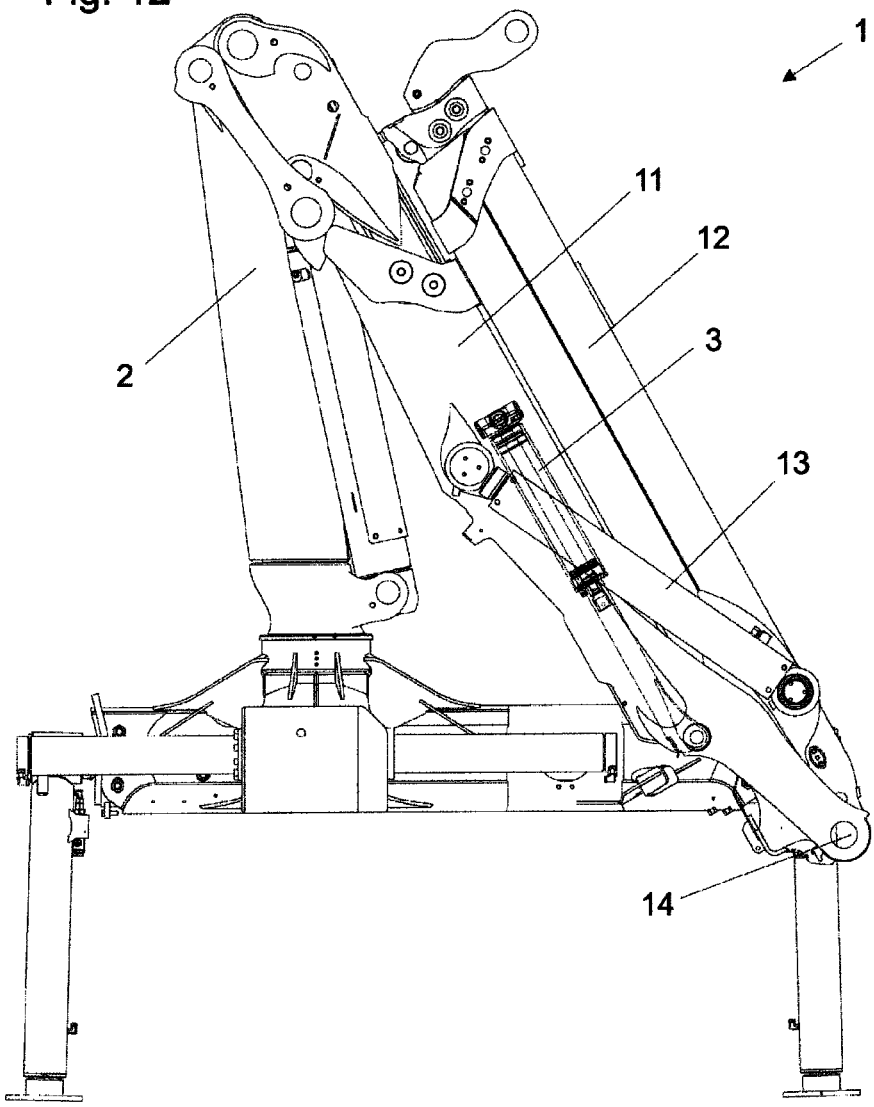
FIGS. 12 and 13 show a Z-crane in the parking position (folded together).

FIG. 12 shows a folded-together Z-crane 1 comprising a crane mast 2 and two crane arms. In this case, the second piston-cylinder unit 3 of the second drive is in the interior of the first crane arm 11.

Figure 13:
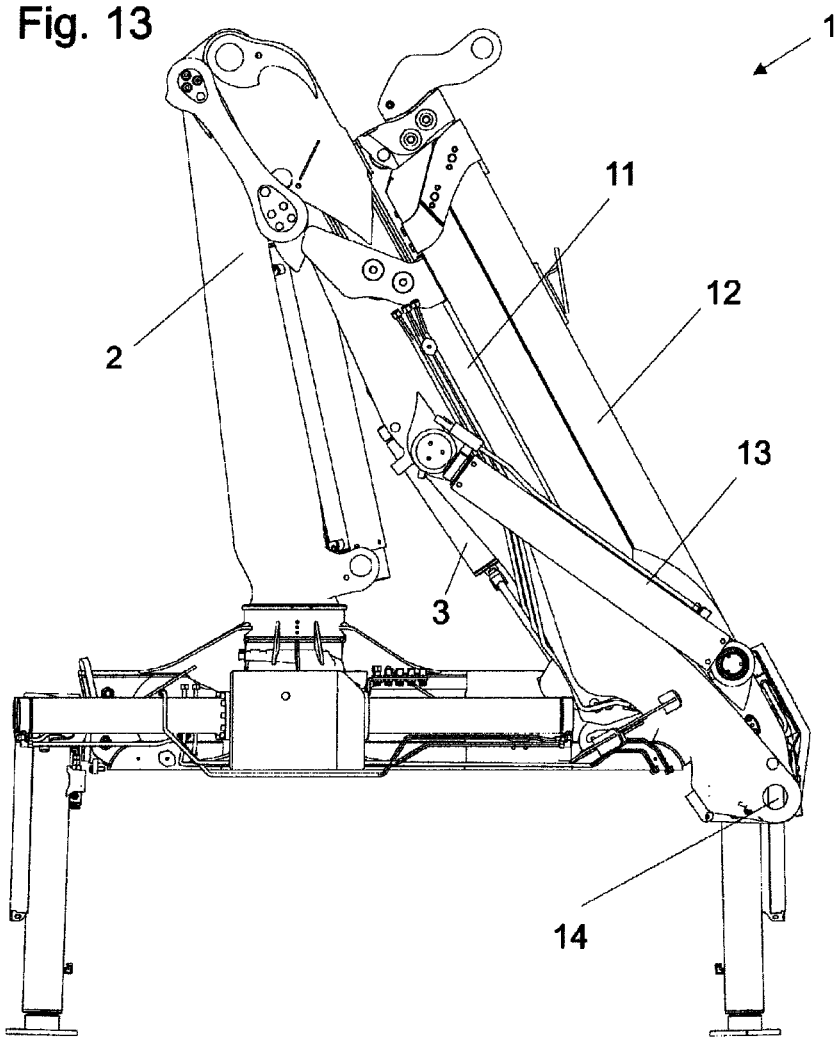

FIG. 13 also shows a folded-together Z-crane 1 (parking position) in which the second piston-cylinder unit 3 of the further drive is mounted externally to the first crane arm 11.

Even if the invention has been described in specific terms by means of the illustrated embodiments, it will be appreciated that the subject-matter of the application is not limited to those embodiments. Rather it will be appreciated that measures and modifications which serve to implement the concept of the invention are certainly conceivable and desired.

LIST OF REFERENCES

1 Z-crane
2 crane mast
3 second piston-cylinder unit of the second drive
4 pulling point of the chain 5
5 chain
6 coupling device
7 first coupling portion
8 second coupling portion
9 lever
11 first crane arm
12 second crane arm
13 first piston-cylinder unit
14 joint
20 control device
21 switching device of the piston-cylinder unit 13
22 switching valve of the switching device 21
23 switching valve of the switching device 24
24 switching device of the piston-cylinder unit 3

The invention claimed is:

1. A crane comprising:

a first crane arm;

a second crane arm connected to said first crane arm by a joint;

a first drive including a piston-cylinder unit for pivoting said first crane arm and said second crane arm relative to each other, said first crane arm, said second crane arm, and said first drive being configured to pivot said first crane arm and said second crane arm starting from either one of two opposite end positions whereat said first crane arm and said second crane arm are in a substantially parallel relationship, said first drive being configured to pivot said first crane arm and said second crane arm relative to each other until said piston-cylinder unit of said first drive reaches a dead point position, the dead point position being a position whereat a longitudinal axis of said piston-cylinder unit is substantially on a line with said joint; and a second drive for pivoting said first crane arm and said second crane arm relative to each other while said piston-cylinder unit of said first drive moves through the dead point position.

2. The crane of claim 1, wherein said second drive includes a linear drive.

3. The crane of claim 2, wherein said linear drive includes a piston-cylinder unit.

4. The crane of claim 1, wherein each of said first crane and said second crane has an underside and a top side opposite said underside, said second drive having a pulling member configured to extend from said underside of said first crane arm to said top side of said second crane arm when said first crane arm and said second crane arm are substantially straight.

5. The crane of claim 4, wherein said pulling member is a chain.

6. The crane of claim 1, wherein said second drive is connected by a releasable coupling device to one of said first crane arm and said second crane arm when said piston-cylinder unit of said first drive is in the dead point position.

7. The crane of claim 6, wherein said coupling device has a first coupling portion mounted to said first crane arm and configured to be coupled to a corresponding second coupling portion when said piston-cylinder unit of said first drive is in the dead point position, said second coupling portion being mounted to said second crane arm, said first coupling portion being configured to be uncoupled from said second coupling portion when said piston-cylinder unit of said first drive is out of the dead point position.

8. The crane of claim 7, wherein said coupling device has a lever.

9. The crane of claim 1, wherein said second drive is arranged substantially completely within an interior of one of said first crane arm and said second crane arm.

10. The crane of claim 1, wherein at least one of said first crane arm and said second crane arm is telescopic.

11. The crane of claim 1, further comprising a control device configured to switch an operative direction of said piston-cylinder unit of said first drive at a given angle of said first crane arm relative to said second crane arm.

12. The crane of claim 11, further comprising a switching device for transmitting a switching signal to said control device.

13. The crane of claim 12, wherein said switching device has a switching valve for reversing the operative direction of said piston-cylinder unit when a switching point of said piston-cylinder unit is reached.

14. The crane of claim 1, wherein a first position of said first crane arm relative to said second crane arm at which the dead point position of said piston-cylinder unit occurs is different from a second position of said first crane arm relative to said second crane arm at which the dead point position of a piston-cylinder unit of said second drive occurs.

15. The crane of claim 1, wherein said piston-cylinder unit of said first drive and said piston-cylinder unit of said second drive are pivotably mounted asymmetrically to at least one of said first crane arm and said second crane arm.

16. The crane of claim 1, wherein said crane is a Z-crane.

17. A vehicle comprising said crane of claim 1.

18. The crane of claim 1, wherein a position of said first crane arm relative to said second crane arm at which the dead point position of said piston-cylinder unit occurs is located between said two opposite end positions with respect to a pivoting movement of said first crane arm relative to said second crane arm.

19. The crane of claim 1, wherein at least one of said two opposite end positions is a parking position for said first crane arm and said second crane arm, said second drive is configured to pivot said first crane arm and said second crane arm relative to each other toward the parking position while said piston-cylinder unit of said first drive moves through the dead point position.

* * * * *